US007322217B2

(12) United States Patent
Namkung et al.

(10) Patent No.: US 7,322,217 B2
(45) Date of Patent: Jan. 29, 2008

(54) DRUM TYPE WASHING MACHINE

(75) Inventors: Koan Seog Namkung, Hwasung-si (KR); Hyun Sook Kim, Suwon-si (KR); Hyoung Hoon Roh, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 637 days.

(21) Appl. No.: 10/900,283

(22) Filed: Jul. 28, 2004

(65) Prior Publication Data

US 2005/0103063 A1 May 19, 2005

(30) Foreign Application Priority Data

Nov. 18, 2003 (KR) ..... 10-2003-0081561

(51) Int. Cl.

| | |
|---|---|
| ***D06B 3/20*** | (2006.01) |
| ***D06F 37/00*** | (2006.01) |
| ***D06F 39/00*** | (2006.01) |
| ***B08B 3/00*** | (2006.01) |
| ***B08B 3/12*** | (2006.01) |
| ***B08B 6/00*** | (2006.01) |
| ***B05C 3/00*** | (2006.01) |

(52) U.S. Cl. ..... 68/24; 68/62; 68/207; 134/198; 118/418

(58) Field of Classification Search ..... 68/62, 68/24, 207; 134/198; 118/418
See application file for complete search history.

(56) References Cited

U.S. PATENT DOCUMENTS

| | | | | |
|---|---|---|---|---|
| 4,868,944 A | | 9/1989 | Ishino et al. | |
| 5,884,506 A | * | 3/1999 | Blauert et al. | 68/17 R |
| 6,463,767 B2 | * | 10/2002 | Uzkureit et al. | 68/58 |
| 2003/0089139 A1 | | 5/2003 | Orszulik | |

FOREIGN PATENT DOCUMENTS

| | | |
|---|---|---|
| DE | 39 15 345 A1 | 12/1989 |
| DE | 42 10 782 A1 | 10/1993 |
| DE | 43 30 079 A1 | 3/1995 |
| DE | 195 00 370 A1 | 7/1996 |
| DE | 101 38 067 A1 | 2/2003 |
| EP | 0 644 290 A | 3/1995 |
| EP | 0 837 172 A | 4/1998 |
| KR | 10-88212 | 9/2001 |
| WO | 99/29953 | 6/1999 |

OTHER PUBLICATIONS

European Search Report dated Sep. 6, 2006 corresponding to European Application No. 04254799.2-2314.

* cited by examiner

*Primary Examiner*—Michael B. Cleveland
*Assistant Examiner*—Joy Watson
(74) *Attorney, Agent, or Firm*—Staas & Halsey LLP

(57) ABSTRACT

A drum type washing machine in which wash water fed to a tub via a water supply pipe is directly supplied into a drum. The washing machine includes a housing, a tub arranged in the housing to contain wash water therein, a drum rotatably mounted in the tub, a water supply pipe adapted to supply wash water into the tub, and a water supply guide unit provided at the tub, to guide the wash water from the water supply pipe to be directly supplied into the drum. Since the wash water is directly supplied into the drum, laundry contained in the drum is wetted by the wash water, immediately after the supply of the wash water. Thus, it is possible to reduce the wash time for the laundry.

17 Claims, 6 Drawing Sheets

DRUM TYPE WASHING MACHINE

CROSS-REFERENCE TO RELATED APPLICATIONS

This application claims the benefit of Korean Patent Application No. 2003-81561, filed on Nov. 18, 2003 in the Korean Intellectual Property Office, the disclosure of which is incorporated herein by reference.

BACKGROUND OF THE INVENTION

1. Field of the Invention

The present invention relates to a drum type washing machine, and more particularly, to a drum type washing machine in which wash water fed to a tub via a water supply pipe is directly supplied into a drum, so that laundry contained in the drum is wetted by the wash water more rapidly.

2. Description of the Related Art

Generally, a drum type washing machine is an appliance for washing laundry contained in a drum by utilizing wash water generated during a rotation of the drum. Such a drum type washing machine includes a housing defining the appearance of the washing machine, a tub fixedly mounted in the housing, and adapted to contain wash water therein, and a drum rotatably mounted in the tub.

A drive motor is installed at a side portion of the housing to rotate the drum. A plurality of through holes are perforated through the drum to allow the wash water in the tub to flow into the drum.

Arranged at an upper portion of the housing are a water supply valve to supply wash water into the tub, a detergent box connected to the water supply valve via a connecting hose, and a water supply pipe for connecting the tub and detergent box.

In a conventional drum-type washing machine, when the water supply valve is opened, wash water is fed to the detergent box via the connecting hose, and is then supplied into the tub via the water supply pipe, along with the detergent contained in the detergent box.

An access opening is formed at a front wall of the housing to allow laundry to be put into and taken out of the drum. A door is also mounted to the front wall of the housing around the access opening such that it is horizontally hingable to open and close the access opening.

When the user desires to wash laundry, using the washing machine having the above mentioned configuration, he puts the laundry into the drum, closes the door, and then opens the water supply valve. In the opened state of the water supply valve, wash water is supplied into the tub, along with detergent. When the drum rotates under this condition, the laundry is raised to the top of the drum and dropped to the bottom of the drum, along with the wash water, in a sequential and repeated manner. Thus, the laundry is washed with wash water generated in accordance with the above mentioned operation.

The water supply pipe, which connects the detergent box and tub, is typically connected to the top of the tub. Due to such a water supply arrangement, the wash water supplied into the tub typically flows downwardly along an outer surface of the drum to gradually fill the interior of the tub from the bottom of the tub.

Thus, wash water can flow into the drum through the through holes formed at the drum after passing through the connecting hose, detergent box, and water pipe in a sequential manner, in the opened state of the water valve, entering the tub to gradually fill the tub from the bottom of the tub, and then reaching a certain level in the water tub. The wash water introduced in the drum permeates the laundry contained in the drum.

In the conventional drum type washing machine having the above mentioned water supply arrangement, however, the permeation of wash water into laundry cannot be carried out, simultaneously with the initiation of the supply of wash water. That is, the wash water in the tub can only reach a desired level, at which it can flow into the drum to permeate the laundry contained in the drum, after a certain time has elapsed from the initiation of the supply of wash water. For this reason, the laundry cannot be wetted by the wash water rapidly, thereby lengthening the washing period.

SUMMARY OF THE INVENTION

Accordingly, it is an aspect of the present invention to provide a drum type washing machine comprising an improved water supply arrangement and capable of wetting laundry with wash water more rapidly.

Additional aspects and/or advantages of the invention will be set forth in part in the description which follows and, in part, will be obvious from the description, or may be learned by practice of the invention.

The foregoing and/or other aspects of the present invention are achieved by providing a drum type washing machine comprising a housing, a tub arranged in the housing to contain wash water therein, a drum rotatably mounted in the tub, a water supply pipe to supply wash water into the tub, and a water supply guide unit provided at the tub, to guide the wash water from the water supply pipe to be directly supplied into the drum.

It is another aspect of the present invention to provide a drum type washing machine comprising a housing, a tub arranged in the housing to contain wash water therein, a drum rotatably mounted in the tub, a drum access opening provided at a front wall of the drum, a water supply pipe to supply wash water into the tub, and a water supply guide unit provided at the tub, to guide the wash water from the water supply pipe into the drum through the drum access opening.

The tub comprises a front wall having a tub access opening. The water supply guide unit is arranged at the front wall of the tub.

The water supply guide unit comprises a water supply hole formed at the front wall of the tub, and connected with an outlet of the water supply pipe, and a water supply guide member to guide the wash water introduced into the tub through the water supply hole to flow into the drum.

The water supply hole and the water supply guide member are arranged above the tub access opening to allow the wash water to fall due to the force of gravity.

The water supply guide member comprises an inner trough member arranged at an inner surface of the front wall of the tub to guide the wash water discharged from the water supply hole to flow toward the outside of the tub, and an outer trough member arranged at an outer surface of the front wall of the tub to guide the wash water flowing toward the outside of the tub in accordance with an operation of the inner trough member to flow toward the inside of the drum.

The inner trough member is arranged to cover the water supply hole and comprises a first inclined extension extending downwardly in a state of being inclined toward the outside of the tub. The outer trough member may be provided with a second inclined extension extending downwardly in a state of being inclined toward the inside of the tub. The first inclined extension is arranged over the second inclined extension.

The housing comprises a housing access opening at a front wall thereof facing the tub access opening, and a door to open and close the housing access opening. The door comprises a door frame to be supported by a portion of the front wall of the housing around the housing access opening in a closed state of the door, and a door glass extending inwardly from the door frame into the tub through the tub access opening by a predetermined length, to allow a user to view the interior of the tub from the outside. The second inclined extension feeds a portion of the wash water to the door glass.

The second inclined extension comprises at least one first guide portion extending into the tub by a predetermined extension length such that the wash water flowing along the second inclined extension falls onto the door glass, and at least one second guide portion extending into the tub by an extension length larger than that of the first guide portion such that the wash water flowing along the second inclined extension falls into the drum beyond the door glass.

The at least one first guide portion comprises a plurality of first guide portions, and the at least one second guide portion comprises a plurality of second guide portions. The first and second guide portions may be alternately arranged.

The second inclined extension comprises a trough at each of the first and second guide portions, and a crest between adjacent ones of the first and second guide portions, the wash water guided by the second inclined extension comprises constant flow directions respectively corresponding to the first and second guide portions.

The drum type washing machine may further comprise a bellows tube connected between the housing access opening and the tub access opening, to prevent leakage of wash water. The water supply hole may be arranged outside the bellows tube. The outer trough member may be arranged inside the bellows tube.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
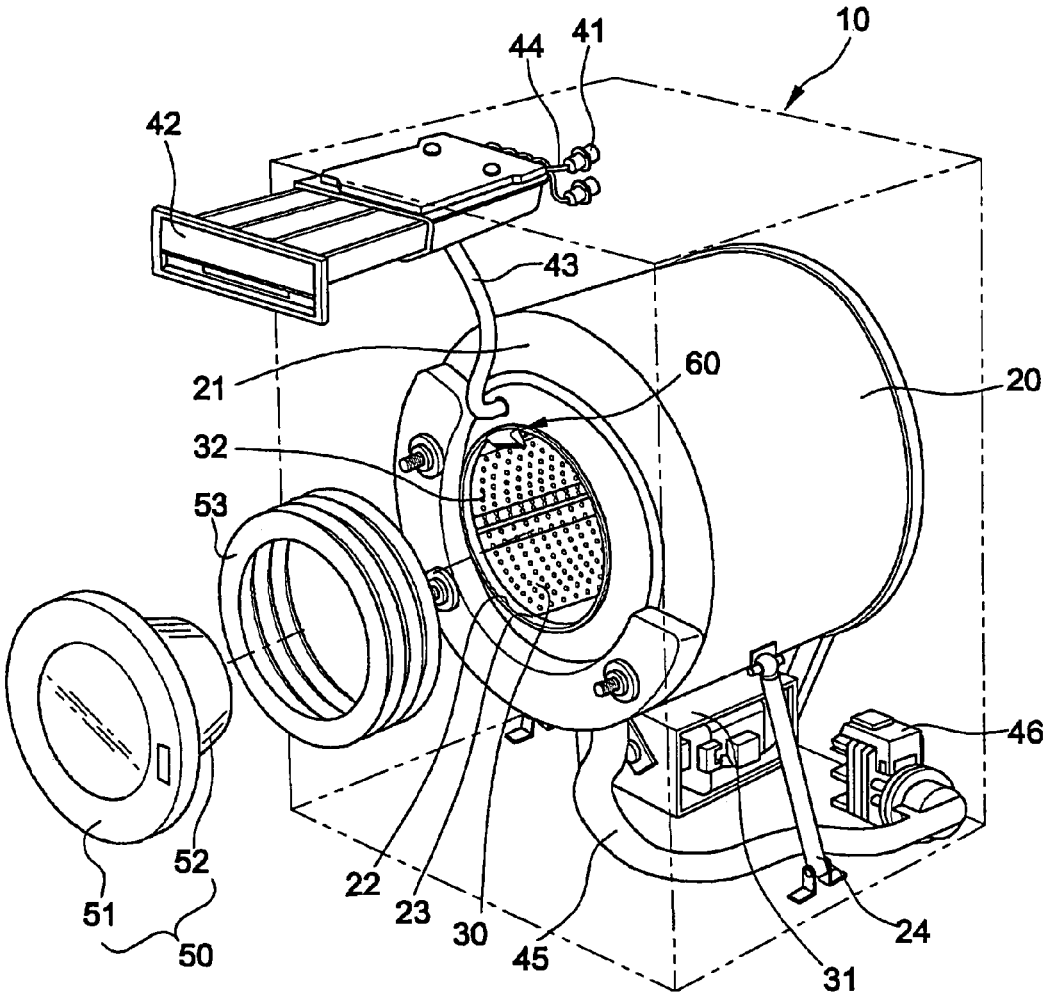
FIG. 1 is a perspective view illustrating the entire configuration of a drum type washing machine according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 2:
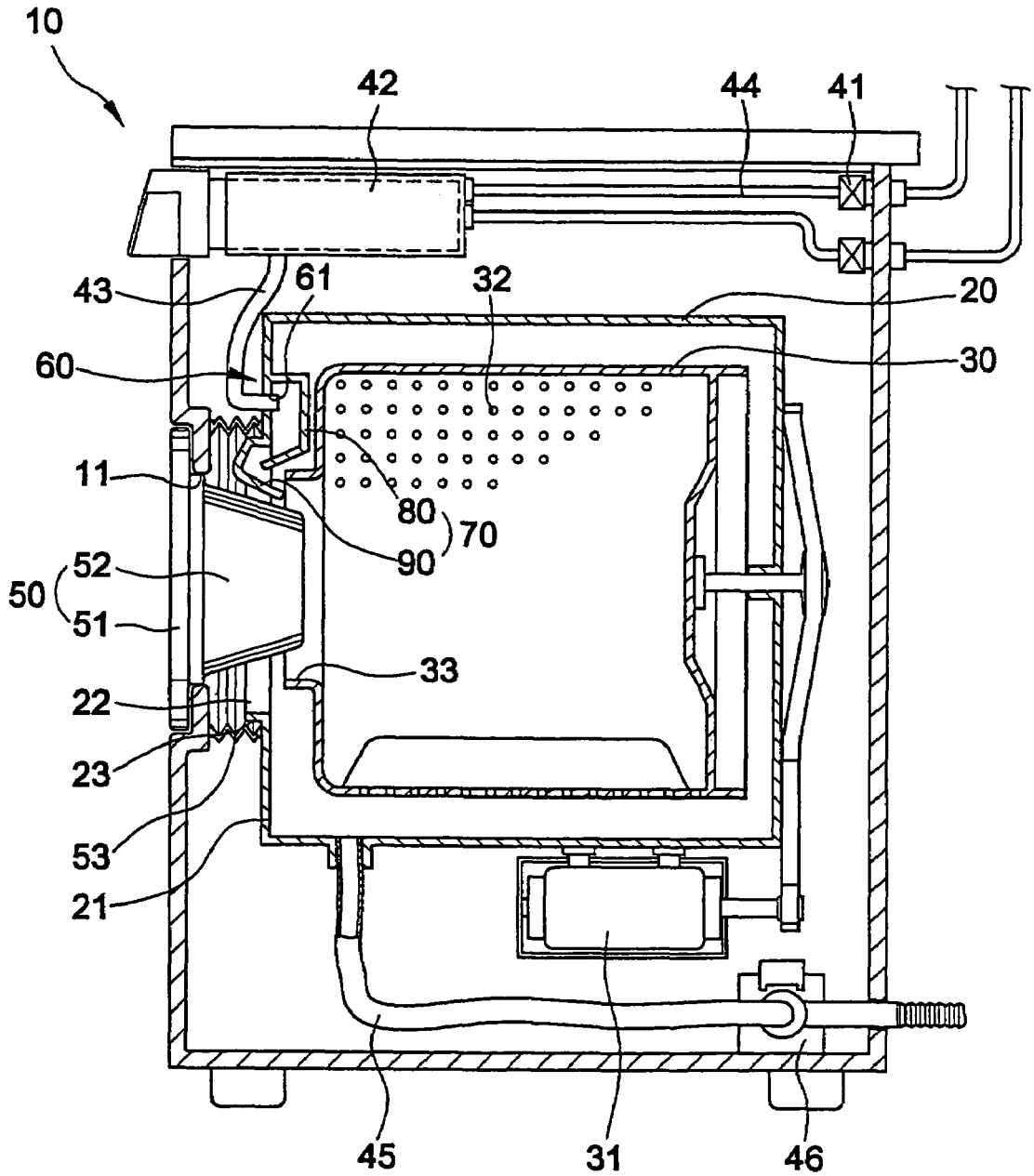
FIG. 2 is a sectional view illustrating the entire configuration of a drum type washing machine as shown in FIG. 1.

In FIGS. 1 and 2, a drum type washing machine according to an embodiment of the present invention is illustrated. The drum type washing machine comprises a housing 10 defining the appearance of the washing machine, and a tub 20 mounted in the housing 10, to contain wash water therein. The tub 20 is firmly supported by the housing 10 at upper and lower portions thereof via respective suspensions (not shown) and respective dampers 24 and comprises a drum 30 rotatably mounted therein.

A drive motor 31 is installed at a side portion of the housing 10 to rotate the drum 30. A plurality of through holes 32 are perforated through the drum 30, to allow the wash water in the tub 20 to flow into the drum 30.

A water supply valve 41 to supply wash water into the tub 20, a detergent box 42 to contain detergent therein, and a water supply pipe 43 to connect the tub 20 with the detergent box 42 are arranged at an upper portion of the housing 10. The water supply valve 41 and detergent box 42 are connected with each other by a connecting hose 44. When the water supply valve 41 is opened, wash water is fed to the detergent box 42 via the connecting hose 44, and is then supplied into the tub 20 via the water supply pipe 43, along with the detergent contained in the detergent box 42. In order to externally drain the wash water from the tub 20, a drainage pipe 45 and a drainage motor 46 are installed at a lower portion of the housing 10.

A tub access opening 22 is formed at a front wall 21 of the tub 20 to allow laundry to be put into and taken out of the drum 30. A housing access opening 11 is also formed at a front wall of the housing 10 such that it is aligned with the tub access opening 22. Also, a drum access opening 33 is formed at a front wall of the drum 30 such that it is aligned with the housing and tub access openings 11 and 22. In order to open and close the housing access opening 11, a door 50 is hingably mounted to the front wall of the housing 10. The door 50 comprises a door frame 51 to be supported by a portion of the front wall of the housing 10 around the housing access opening 11 in a closed state of the door 50, and a door glass 52 provided at a central portion of the door frame 51 while extending inwardly into the interior of the tub 20 through the tub access opening 22 by a desired length to allow the user to view the interior of the tub 20 from the outside.

A bellows tube 53 is connected between the housing access opening 11 and the tub access opening 22, to prevent the wash water in the tub 20 from leaking to the outside during operation of the washing machine. In the closed state of the door 50, the interior of the tub 20 is maintained in a sealed state by the bellows tube 53.

When the user desires to wash laundry, using the washing machine having the above mentioned configuration, he puts the laundry into the drum 30, closes the door 50, and then opens the water supply valve 41. In the opened state of the water supply valve 41, wash water is supplied into the tub 20, along with detergent. When the drum 30 rotates under this condition, the laundry is raised to the top of the drum 30 and dropped to the bottom of the drum 30, along with the wash water, in a sequential and repeated manner. Thus, the laundry is washed with wash water generated in accordance with the above mentioned operation.

A water supply guide unit 60 is provided at the tub 20 to guide the wash water fed to the tub 20 via the water supply pipe 43 to be directly supplied into the drum 30. That is, the water supply guide unit 60 allows wash water to be supplied into the drum 30 through the drum access opening 33 immediately after supply of the wash water to the tub 20 is initiated, thereby allowing laundry contained in the drum 30 to be wetted by the wash water more rapidly, and thus, reducing the wash time of the laundry. The configuration of the water supply guide unit 60 will now be described in detail.

In FIG. 2, the water supply guide unit 60 comprises a water supply hole 61 provide at the front wall 21 of the tub 20, and connected to an outlet of the water supply pipe 43, and a water supply guide member 70 provided at the front wall 21 of the tub 20, to guide wash water fed to the tub 20 through the water supply hole 61 to be immediately supplied into the drum 30. The water supply hole 61 and water supply guide member 70 are arranged above the tub access opening 22 so that wash water is supplied into the drum 30 due to the force of gravity without use of a pump or the like.

Figure 3:
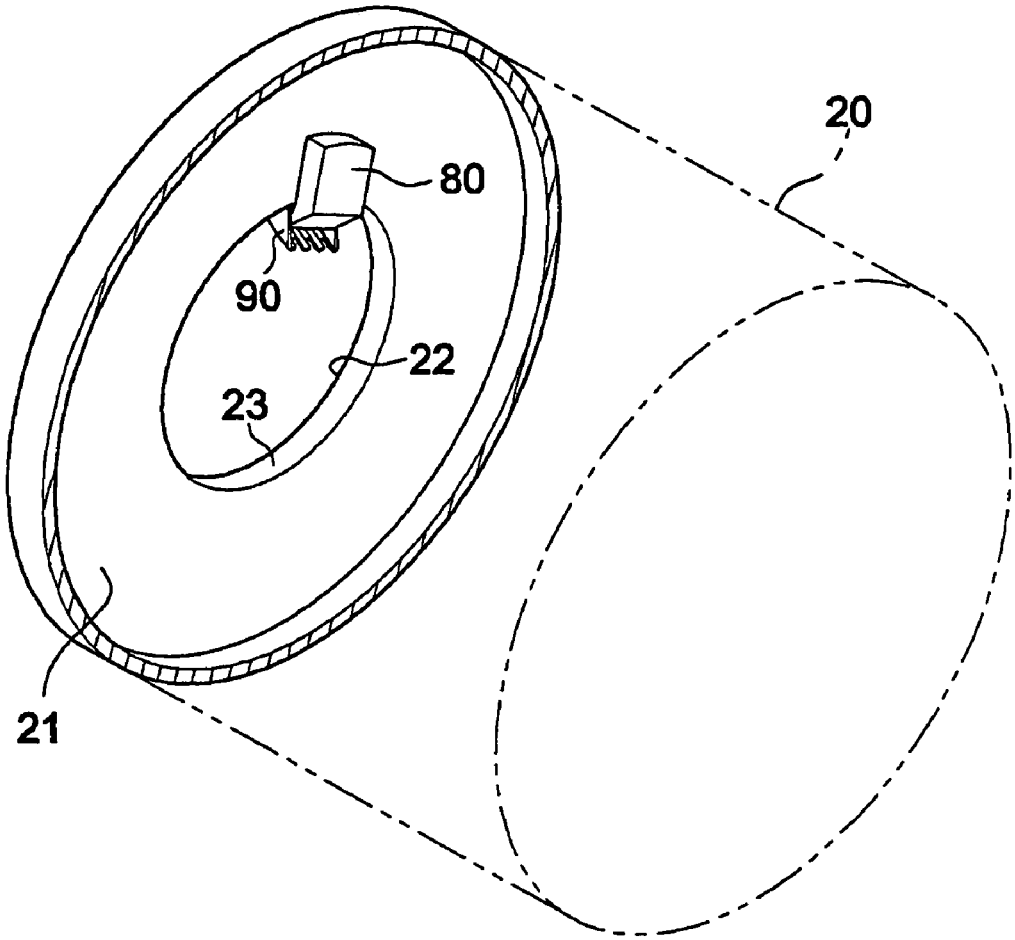
FIGS. 3 and 4 are rear and front perspective views illustrating a configuration of a tub included in the drum type washing machine, respectively, as shown in FIG. 1.
Figure 4:
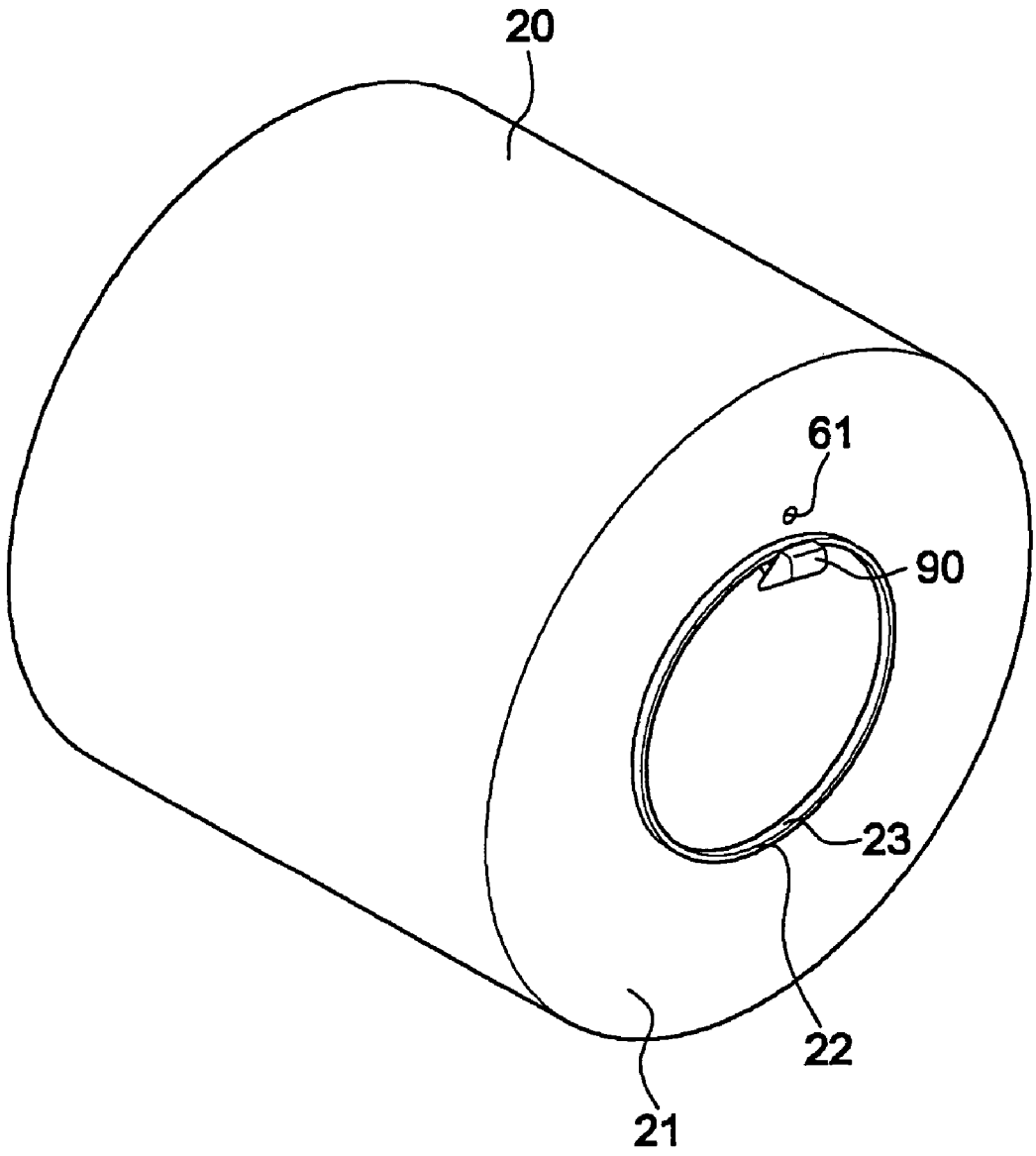

In FIGS. 3 and 4, the water supply guide member 70 comprises an inner trough member 80 arranged at an inner surface of the front wall 21 to guide wash water introduced into the tub 20 toward the outside of the tub 20, and an outer trough member 90 arranged at an outer surface of the front wall 21 to guide the wash water flowing toward the outside of the tub 20 in accordance with the guide of the inner trough member 80 to again flow toward the inside of the drum 30.

Figure 5:
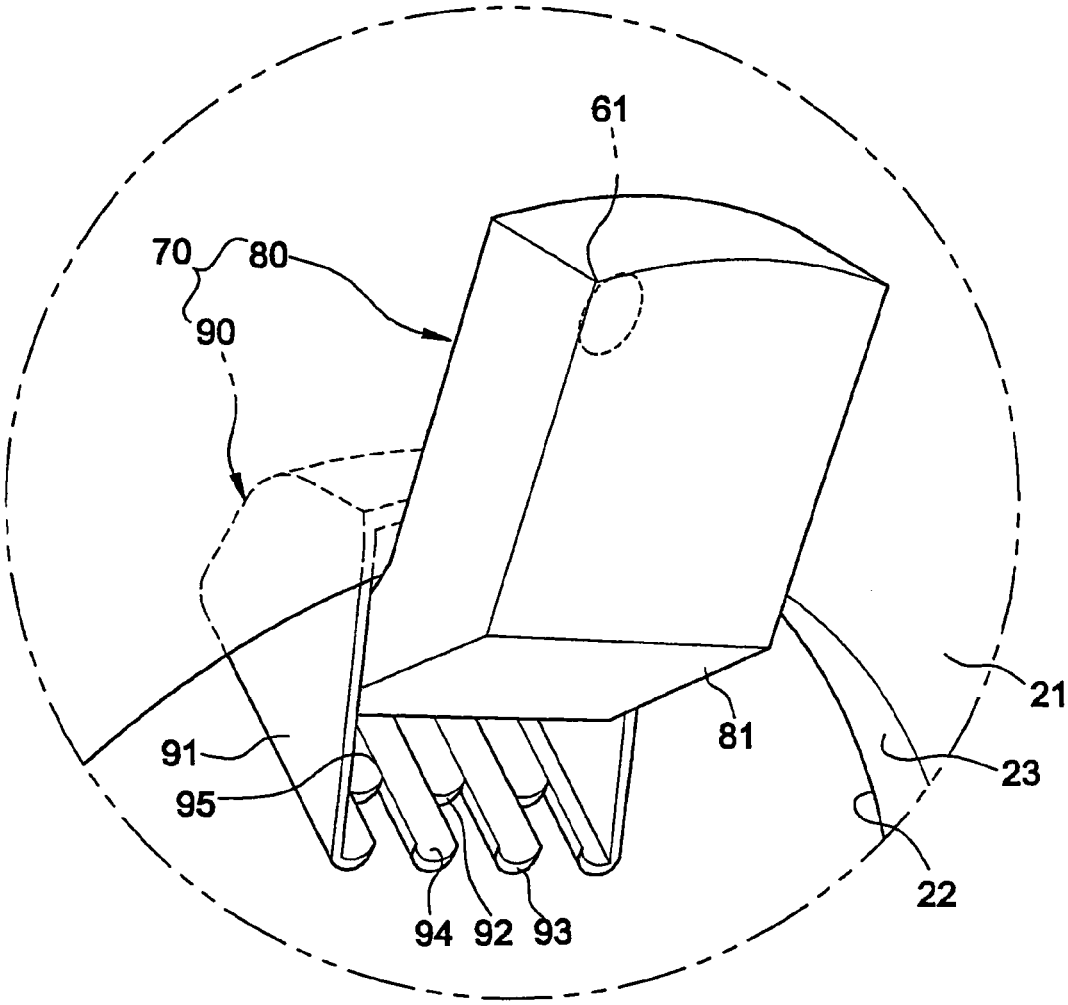
FIGS. 5 and 6 are rear and front perspective views illustrating a configuration of a water supply guide unit included in the drum type washing machine, respectively, as shown in FIG. 1.
Figure 6:
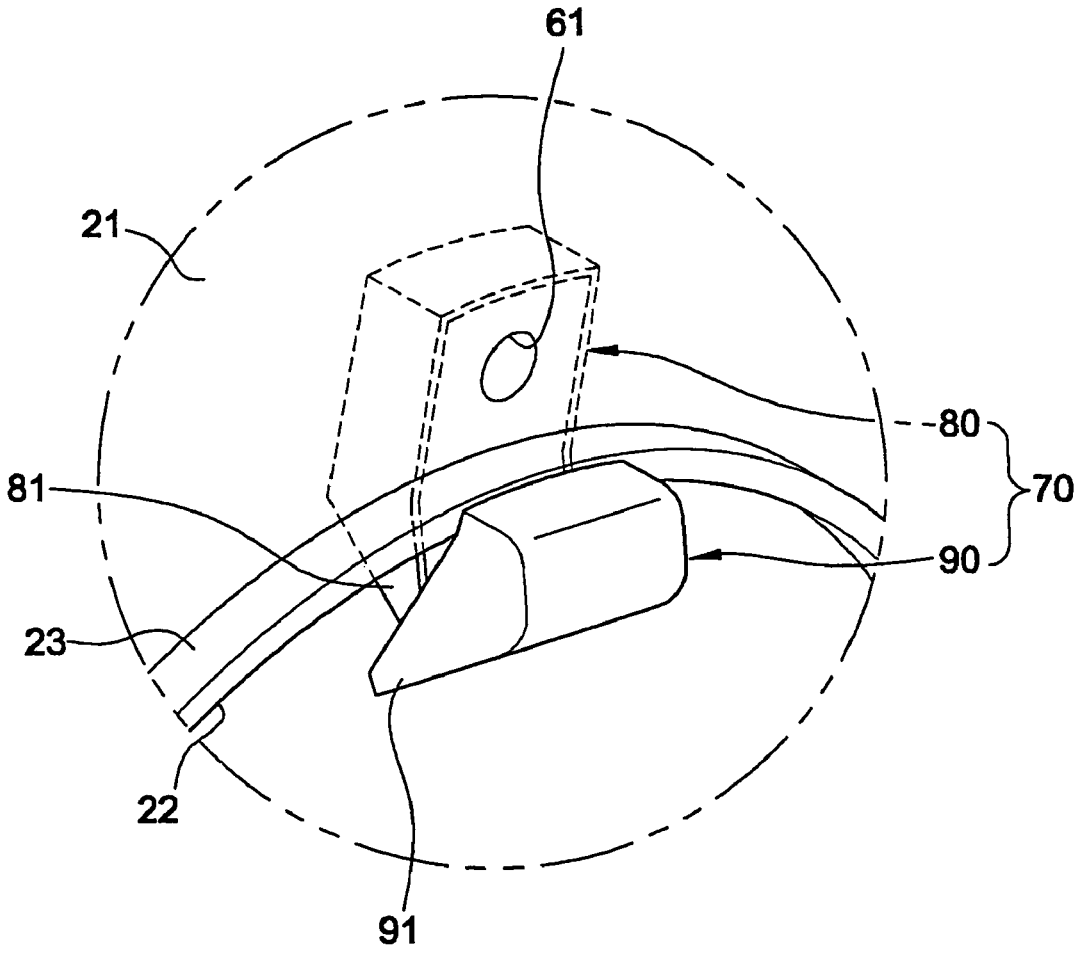

In FIGS. 5 and 6, the inner trough member 80 has an upper portion mounted to the inner surface of the front wall 21 while covering the water supply hole 61. The inner trough member 80 is also provided, at a lower end thereof, with a first inclined extension 81 extending downwardly from the lower end while being inclined toward the outside of the tub 20. Meanwhile, an extension 23 extends from the front wall 21 around the tub access opening 22 toward the front wall of the housing 10. The outer trough member 90 is mounted, at an upper end thereof, to a free end of the extension 23 such that it is integral with the extension 23. The outer trough member 90 is provided, at a lower end thereof, with a second inclined extension 91 extending downwardly from the lower end while being inclined toward the inside of the tub 20.

In accordance with the above described structure of the water supply guide member 70, wash water fed to the water supply guide member 70 via the water supply pipe 43 is first introduced into the inner trough member 80. The wash water is then introduced into the outer trough member 90 as it is guided by the first inclined extension 81 of the inner trough member 80. Thereafter, the wash water is supplied into the drum 30 through the drum access opening 33 as it is guided by the second inclined extension 91. In order to prevent the wash water fed from the inner trough member 80 to the outer trough member 90 from leaking between the inner and outer trough members 80 and 90, the first inclined extension 81 is arranged over the second inclined extension 91.

In the illustrated embodiment of the present invention, the inner and outer trough members 80 and 90 forming the water supply guide member 70 are separately configured in such a manner that the inner trough member 80 is mounted to the inner surface of the front wall 21, whereas the outer trough member 90 is formed integrally with the front wall 21. However, the inner and outer trough members 80 and 90 may have an integral structure mounted to the front wall 21. Alternatively, the inner and outer trough members 80 and 90 have separate structures formed integrally with the front wall 21, respectively. Also, the inner and outer trough members 80 and 90 have separate structures mounted to the inner and outer surfaces of the front wall 21, respectively. The impact point of the wash water falling into the drum 30 after being fed to the drum 30 via the water supply guide member 70 may vary, depending on the inclinations of the first and second inclined extensions 81 and 91. Accordingly, the inclinations of the first and second inclined extensions 81 and 91 are designed, taking into consideration the impact point of the wash water falling into the drum 30.

The second inclined extension 91 supplies a portion of the wash water, fed into the drum 30, toward the door glass 52 of the door 50. That is, as shown in FIG. 5, the second inclined extension 91 comprises at least one first guide portion 92 extending into the tub 20 by a small extension length such that the wash water flowing along the second inclined extension 91 falls onto the door glass 52, and at least one second guide portion 93 extending into the tub 20 by an extension length larger than that of the first guide portion 92 such that the wash water flowing along the second inclined extension 91 falls into the drum 30 beyond the door glass 52. In accordance with the structure of the second inclined extension 91 comprising the first and second guide portions 92 and 93, a portion of the wash water guided to the drum via the water supply guide member 70 is directly supplied into the drum 30, to allow laundry contained in the drum 30 to be wetted more rapidly by the supplied wash water, whereas the remaining portion of the wash water is supplied into the drum 30 after falling onto the door glass 52, to remove foreign matter such as bubbles attached to the door glass 52. Accordingly, the user can easily visually identify the washed state of the laundry in the drum 30 through the door glass 52 from the outside.

In the illustrated embodiment of the present invention, the second inclined extension 91 comprises a plurality of first guide portions 92 and a plurality of second guide portions 93 provided such that they are alternately arranged. That is, each first guide portion 92 is arranged between adjacent ones of the second guide portions 93, and each second guide portion 93 is arranged between adjacent ones of the first guide portions 92. In accordance with such an alternate arrangement, the flow width of the wash water falling into the drum 30 and the flow width of the wash water falling onto the door glass 52 can be enlarged. Each of the first and second guide portions 92 and 93 comprises a trough 94. Also, a crest 95 is formed between adjacent ones of the first and second guide portions 92 and 93. By using the troughs 94 and crests 95, the wash water guided by the second inclined extension 91 flows constantly, respectively directed to the interior of the drum 30 and the door glass 52.

When the bellows tube 53, which is connected between the housing access opening 11 and the tub access opening 22 to seal the interior of the tub 20 in the closed state of the door 50, closes the water supply hole 61, or the outer trough member 90 of the water supply guide member 70, is exposed to the outside of the bellows tube 53, there is a difficulty in achieving the connection of the water supply pipe 43 or the supply of wash water into the drum 30. For this reason, it is preferred that the water supply hole 61 is arranged outside the bellows tube 53, and the outer trough member 90 is arranged inside the bellows tube 53.

As described above, in the drum type washing machine according to an aspect of the present invention, wash water fed to the tub 20 via the water supply pipe 43 is directly supplied into the drum 30 by the water supply guide unit 60 comprising the water supply hole 61 and water supply guide member 70, so that the laundry contained in the drum 30 can be wetted by the wash water more rapidly. Accordingly, it is possible to reduce the wash time for the laundry. A portion of the wash water, to be supplied into the drum 30, is fed to the door glass 52 of the door 50 by the first guide portions 92 provided at the second inclined extension 91 of the outer trough member 90 included in the water supply guide member 70. Accordingly, it is possible to effectively remove foreign matter such as bubbles attached to the door glass 52.

Now, the operation, function, and effect of the washing machine having the above described configuration according to the aspect of the present invention will be described in detail.

When the user desires to wash laundry, using the washing machine, he puts the laundry into the drum 30, closes the door 50, and then opens the water supply valve 41. In the opened state of the water supply valve 41, wash water is fed to the detergent box 42 via the connecting hose 44, and is then introduced into the water supply pipe 43, along with detergent contained in the detergent box 42. The wash water is then fed to the tub 20 through the water supply hole 61 formed at the front wall 21 of the tub 20. The wash water fed to the tub 20 is guided by the first inclined extension 81 provided at the inner trough member 80 of the water supply guide member 70 to flow toward the outside of the tub 20 and then to reach the outer trough member 90 of the water supply guide member 70. The wash water reaching the outer trough member 90 is then guided by the second inclined extension 91 of the outer trough member 90 to flow toward the inside of the tub 20. At this time, the wash water guided by the first guide portions 92 of the second inclined extension 91 each having a small extension length falls onto the door glass 52, so that it removes foreign matter such as bubbles attached to the door glass 52 during a washing operation. On the other hand, the wash water guided by the second guide portions 93 each having an extension length larger than that of the first guide portions 92 falls into the drum 30 beyond the door glass 52, so that it immediately permeates the laundry contained in the drum 30. When the drum 30 rotates under this condition, the laundry is raised to the top of the drum 30 and dropped to the bottom of the drum 30, along with the wash water, in a sequential and repeated manner. Thus, the laundry is washed by the wash water generated in accordance with the above mentioned action of the laundry and wash water. In this case, the laundry can be completely washed within a reduced time because it has been wetted by the wash water immediately after the wash water has been supplied by the water supply guide unit 60.

As apparent from the above description, in accordance with the drum type washing machine according to the present invention, wash water fed to the tub via the water supply pipe is directly supplied into the drum by the water supply guide unit arranged at the front wall of the tub. Accordingly, laundry contained in the drum can be wetted by the wash water, immediately after the supply of the wash water. Thus, it is possible to reduce the wash time for the laundry.

The water supply guide unit of the drum type washing machine according to the present invention guides a portion of the wash water, to be supplied into the drum, toward the door glass, to remove foreign matter such as bubbles attached to the door glass.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A drum type washing machine comprising:

a housing;

a tub arranged in the housing to contain wash water therein;

a drum rotatably mounted in the tub;

a water supply pipe to supply wash water into the tub; and a water supply guide unit provided at the tub, to guide the wash water from the water supply pipe to be directly supplied into the drum, wherein the tub comprises a front wall provided with a tub access opening, the water supply guide unit is arranged at the front wall of the tub, the water supply guide unit includes a water supply hole formed at the front wall of the tub, and connected with an outlet of the water supply pipe, and a water supply guide member to guide the wash water introduced into the tub through the water supply hole to flow into the drum, and the water supply guide member comprises an inner trough member arranged at an inner surface of the front wall of the tub to guide the wash water discharged from the water supply hole to flow toward an outside of the tub, and an outer trough member arranged at an outer surface of the front wall of the tub to guide the wash water flowing toward the outside of the tub in accordance with an operation of the inner trough member to flow toward an inside of the drum.

2. The drum type washing machine of claim 1, wherein:

the drum comprises a drum access opening at a front wall thereof facing the tub access opening; and the water supply guide unit guides the wash water to be supplied into the drum through the drum access opening.

3. The drum type washing machine of claim 2, wherein the water supply hole and the water supply guide member are arranged above the tub access opening to allow the wash water to fall due to the force of gravity.

4. The drum type washing machine of claim 1, wherein:

the inner trough member is arranged to cover the water supply hole and comprises a first inclined extension extending downwardly and inclined toward the outside of the tub;

the outer trough member comprises a second inclined extension extending downwardly and inclined toward the inside of the tub, wherein the first inclined extension is arranged over the second inclined extension.

5. The drum type washing machine of claim 4, wherein:

the housing comprises a housing access opening at a front wall thereof facing the tub access opening, and a door to open and close the housing access opening;

the door comprises a door frame to be supported by a portion of the front wall of the housing around the housing access opening in a closed state of the door, and a door glass extending inwardly from the door frame into the tub through the tub access opening by a predetermined length to allow a user to view the interior of the tub from an outside of the drum type washing machine; and the second inclined extension feeds a portion of the wash water to the door glass.

6. The drum type washing machine of claim 5, wherein the second inclined extension comprises at least one first guide portion extending into the tub by a predetermined extension length such that the wash water flowing along the second inclined extension falls onto the door glass, and at least one second guide portion extending into the tub by an extension length larger than that of the first guide portion such that the wash water flowing along the second inclined extension falls into the drum beyond the door glass.

7. The drum type washing machine of claim 6, wherein:

the at least one first guide portion comprises a plurality of first guide portions, and the at least one second guide portion comprises a plurality of second guide portions, wherein the first and second guide portions are alternately arranged.

8. The drum type washing machine of claim 7, wherein the second inclined extension comprises a trough at each of the first and second guide portions, and a crest between adjacent ones of the first and second guide portions, so that the wash water guided by the second inclined extension flows in a constant direction, respectively corresponding to the first and second guide portions.

9. The drum type washing machine of claim 1, further comprising:

a bellows tube connected between the housing access opening and the tub access opening to prevent leakage of wash water, wherein the water supply hole is arranged outside the bellows tube, and the outer trough member is arranged inside the bellows tube.

10. A drum type washing machine comprising:

a housing;

a tub arranged in the housing to contain wash water therein;

a drum rotatably mounted in the tub;

a drum access opening provided at a front wall of the drum;

a water supply pipe adapted to supply wash water into the tub; and a water supply guide unit provided at the tub, to guide the wash water from the water supply pipe into the drum through the drum access opening, wherein the tub comprises a front wall provided with a tub access opening, the water supply guide unit is arranged at the front wall of the tub, the water supply guide unit comprises a water supply hole formed at the front wall of the tub, and connected with an outlet of the water supply pipe, and a water supply guide member to guide the wash water introduced into the tub through the water supply hole to flow into the drum, and the water supply guide member comprises an inner trough member arranged at an inner surface of the front wall of the tub to guide the wash water discharged from the water supply hole to flow toward an outside of the tub, and an outer trough member arranged at an outer surface of the front wall of the tub to guide the wash water flowing toward the outside of the tub in accordance with an operation of the inner trough member to flow toward an inside of the drum.

11. The drum type washing machine of claim 10, wherein the water supply hole and the water supply guide member are arranged above the tub access opening to allow the wash water to fall due to the force of gravity.

12. The drum type washing machine of claim 10, wherein:

the inner trough member is arranged to cover the water supply hole and comprises a first inclined extension extending downwardly and inclined toward the outside of the tub;

the outer trough member comprises a second inclined extension extending downwardly in a state of being inclined toward the inside of the tub, wherein the first inclined extension is arranged over the second inclined extension.

13. The drum type washing machine of claim 12, wherein:

the housing comprises a housing access opening at a front wall thereof facing the tub access opening, and a door to open and close the housing access opening;

the door comprises a door frame adapted to be supported by a portion of the front wall of the housing around the housing access opening in a closed state of the door, and a door glass extending inwardly from the door frame into the tub through the tub access opening by a predetermined length to allow a user to view the interior of the tub from an outside of the drum-type washing machine; and the second inclined extension feeds a portion of the wash water to the door glass.

14. The drum type washing machine of claim 13, wherein the second inclined extension comprises at least one first guide portion extending into the tub by a predetermined extension length such that the wash water flowing along the second inclined extension falls onto the door glass, and at least one second guide portion extending into the tub by an extension length larger than that of the first guide portion such that the wash water flowing along the second inclined extension falls into the drum beyond the door glass.

15. The drum type washing machine of claim 14, wherein:

the at least one first guide portion comprises a plurality of first guide portions, and the at least one second guide portion comprises a plurality of second guide portions, wherein the first and second guide portions are alternately arranged.

16. The drum type washing machine of claim 15, wherein the second inclined extension comprises a trough at each of the first and second guide portions, and a crest between adjacent ones of the first and second guide portions, wherein the wash water guided by the second inclined extension flows in a constant direction, respectively corresponding to the first and second guide portions.

17. The drum type washing machine of claim 10, further comprising a bellows tube connected between the housing access opening and the tub access opening to prevent leakage of wash water, wherein the water supply hole is arranged outside the bellows tube, and the outer trough member is arranged inside the bellows tube.

* * * * *